United States Patent [19]

Rain

[11] 4,041,653

[45] Aug. 16, 1977

[54] STRESS RELIEVED AIR SUPPORTED STRUCTURE

[75] Inventor: Lloyd H. Rain, Lexington, Ky.

[73] Assignee: Irvin Industries, Inc., Stamford, Conn.

[21] Appl. No.: 690,692

[22] Filed: May 27, 1976

[51] Int. Cl.[2] ..... E04B 1/345; E04B 1/347

[52] U.S. Cl. ..... 52/2; 135/1 R; 135/15 CF; 135/DIG. 8

[58] Field of Search ..... 52/2; 135/1 R, 15 CF, 135/8, DIG. 5, DIG. 8; 244/115, 126, 127

[56] References Cited

U.S. PATENT DOCUMENTS

| | | | |
|---|---|---|---|
| 2,497,596 | 2/1950 | Frieder et al. | 135/1 R |
| 3,116,746 | 1/1964 | Bird | 52/2 |
| 3,159,165 | 12/1964 | Cohen et al. | 52/2 |
| 3,241,269 | 3/1966 | Reffell | 52/2 |
| 3,769,763 | 11/1973 | Kwake | 52/2 |

FOREIGN PATENT DOCUMENTS

| | | | |
|---|---|---|---|
| 1,309,317 | 10/1962 | France | 52/2 |

*Primary Examiner*—James L. Ridgill, Jr.

*Attorney, Agent, or Firm*—Beveridge, DeGrandi, Kline & Lunsford

[57] ABSTRACT

A stress relieved air supported structure having a wall portion including a plurality of relatively elongated panel members joined together by seam means and restrained by harness means; anchor means being provided along the base perimeter of the wall portion; each of the panel members including a membrane configuration, adjoining panel members being joined together by a seam means and having web means interconnected thereto along the seam thereof, and wherein the load of the harness means, seam means, anchor means, and the load and stress of the membrane configurations thereof are a function of the width and height of the air supported structure, the primary radius of curvature thereof, and the design wind speed and inflation pressure thereof.

26 Claims, 17 Drawing Figures

FIG. 1
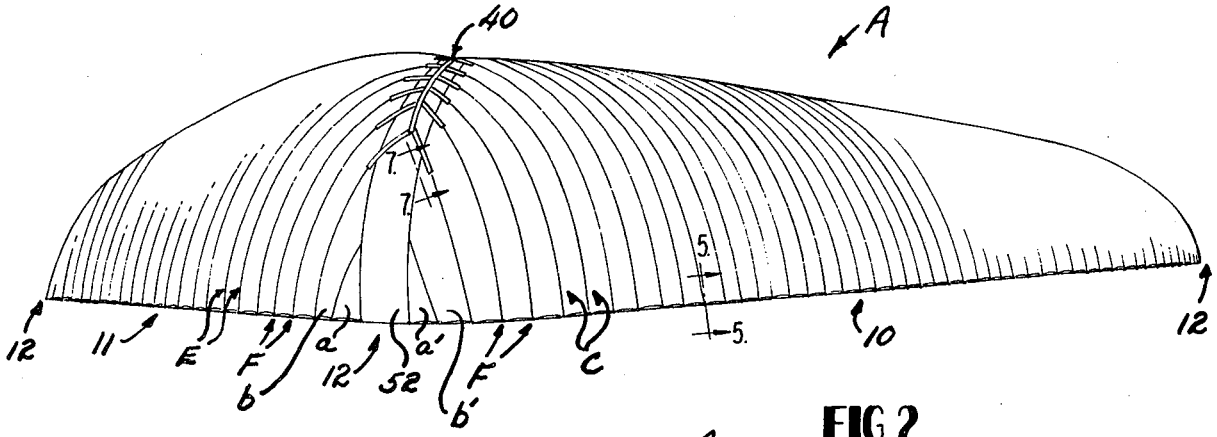
FIG. 2
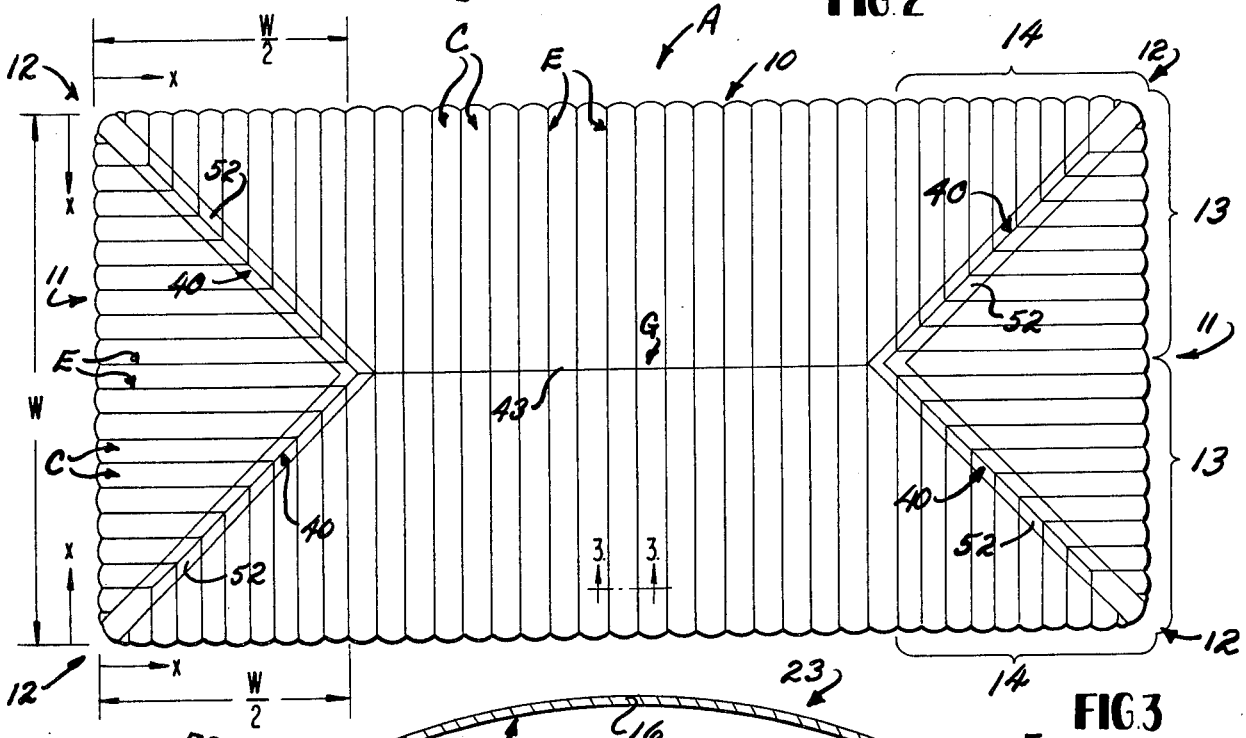
FIG. 3
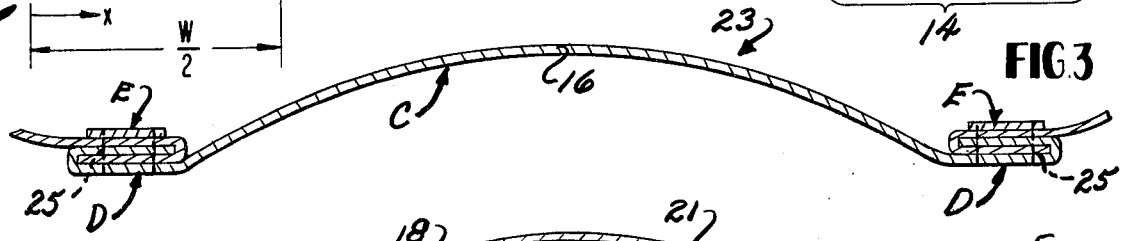
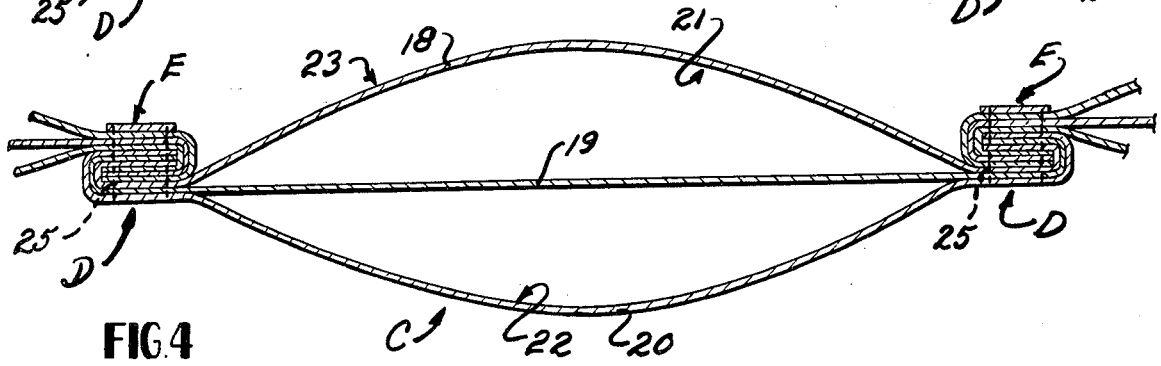
FIG. 4

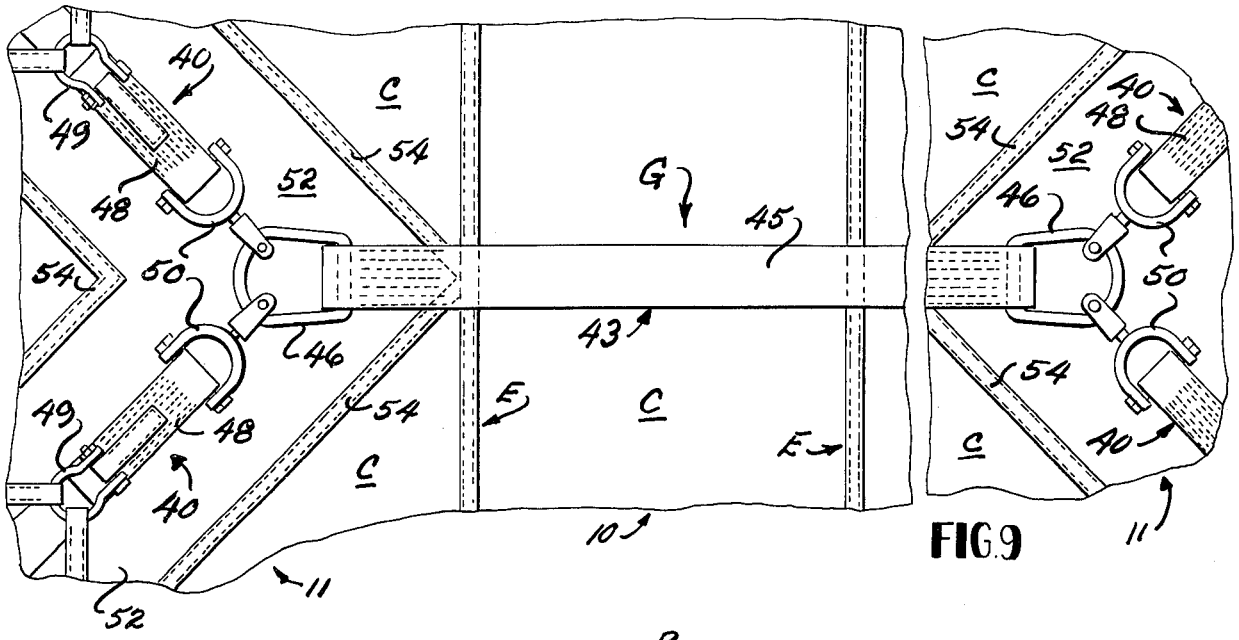
FIG.9
FIG.10
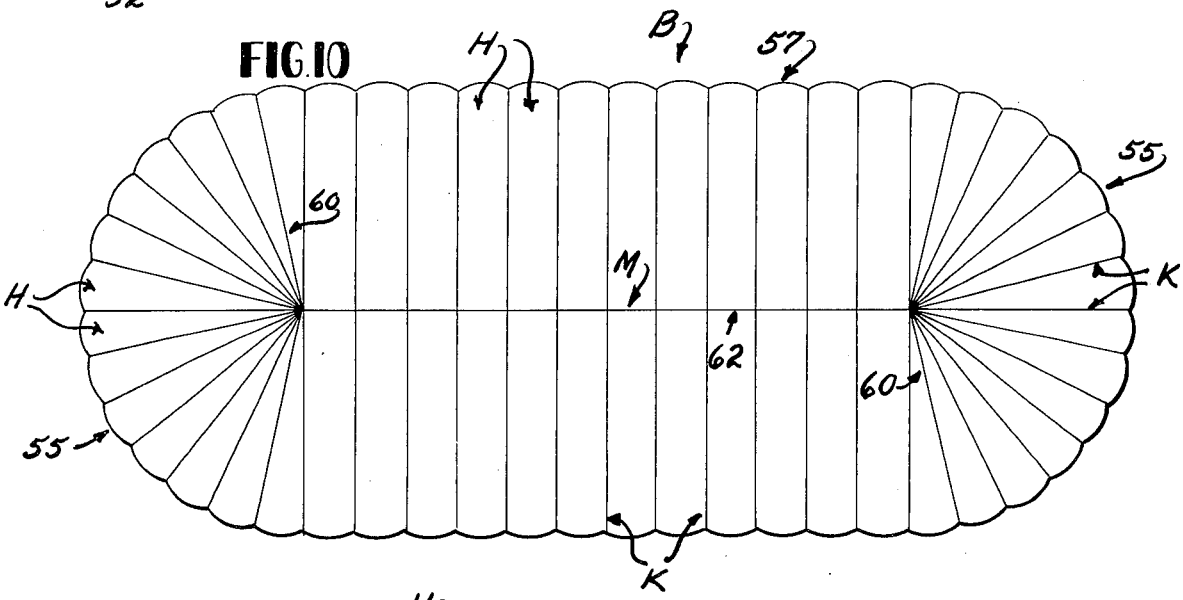
FIG.11
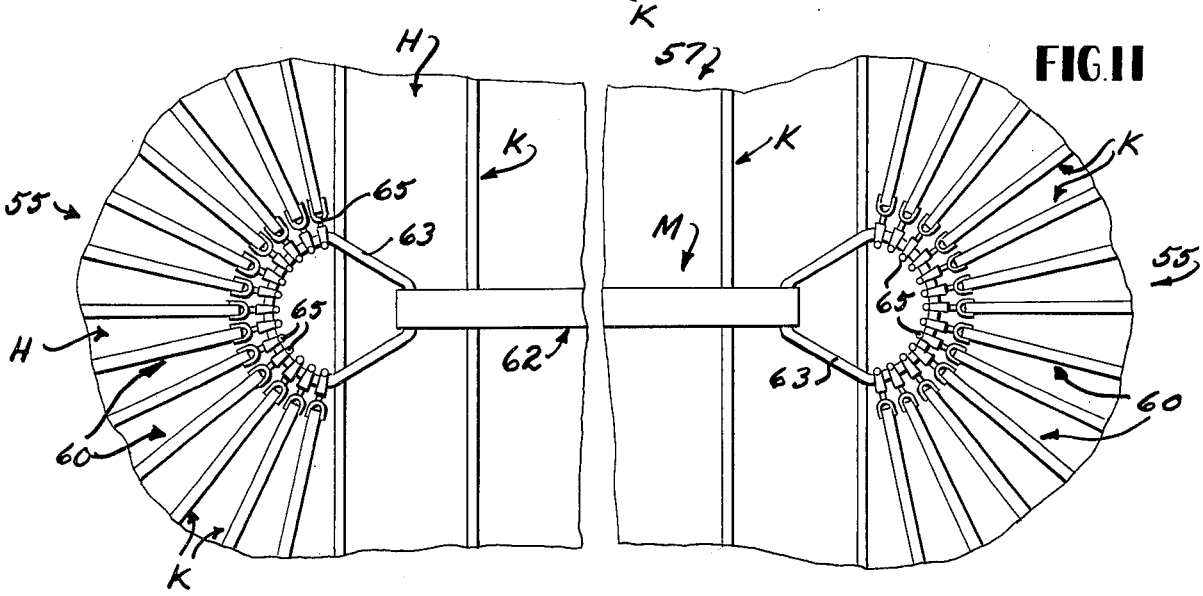

STRESS RELIEVED AIR SUPPORTED STRUCTURE

BRIEF BACKGROUND, FIELD AND OBJECTIVES OF THE INVENTION

This invention relates to improvements in the provision of stress relieved air supported structures.

The majority of air supported structures presently in use include a membrane envelope which has been fabricated from commercial high strength industrial fabric such as is readily available in the particular area wherein the same is to be constructed, providing a low cost portable or semi-permanent enclosure which is adequately serviceable under conditions where temporary collapse would not be of serious consequence. With the growing interest in use of air supported structures of larger sizes and as relatively permanent installations, a need has developed to provide air supported structures having long term structural integrity and weather resistance. It is accordingly a primary object of the present invention to provide an air supported structure having long term structural integrity and weather resistance.

An air supported structure having structural integrity must be generally designed to withstand two primary types of loading, namely:

1. Static and uniform loading produced by inflation pressure within the air supported structure, which is generated from the input of air from blower systems usually provided for discharging air interiorally of the air supported structure about the perimeter thereof; and 2. The generally asymmetric loading produced by air flow over the exterior of the structure, and which is usually referred to as aerodynamic loading.

Of course, various other generally asymmetric load factors may be encountered, such as by snow, etc. However, in the absence of extreme loading caused by such other factors, and in connection with which it is unlikely that an air supported structure could be readily designed to resist the same, or in the location in which the same were excessive, use of an air supported structure would not likely be considered, air supported structures according to the present invention, and within the design limits herein specified with respect to the shape of the air supported structure and the design wind velocity thereof, will normally withstand such other loading factors.

Aerodynamic loading varies as the square of the exterior wind velocity and is proportionately much larger than the normal stresses due to inflation pressure alone. Further, although inflation pressure is constant and aerodynamic loading will generally be variable, the two types of loads are usually additive and almost invariably act in the same direction. When such non-uniform loading occurs, equilibrium conditions in the air supported structure can be achieved either by redistribution of load, or by distortion of the structure. It is believed quite obvious that distortion is undesirable and that redistribution of load factors is almost a necessity for maintenance of a usable air supported structure.

Loading conditions which would normally result in a compressive stress in rigid structures are resisted in an air supported structure as a relaxation of tensile loads imposed by the initial inflation pressure. Thus, a hemispherical dome shaped air supported structure is quite stable, as the pretensioning loads imposed by inflation pressure are distributed uniformly. However, in the case of a semi-cylindroidal shaped air supported structure, stresses resulting from pressure differential, hoop tension, are irregularly distributed. For instance, aerodynamic loading along a lateral section through a semi-cylindroidal air supported structure causes a distortion or change in radial shape along the entire length thereof in order to even approximately equalize tensions between opposed anchor points which is required in order to maintain the air supported structure in equilibrium.

In order to maintain the basic envelope of an air supported structure in substantially static equilibrium, I provide the same with a network of stress relieving members for carrying the resultants of aerodynamic and inflation pressure loads. Thus, the basic envelope distributes the pressure loads to the stress relieving members.

Accordingly, it is a further object of this invention to provide an air supported structure having an interconnected and/or interrelated network of stress relieving members which maintains the air supported structure in substantially static equilibrium under normal conditions of asymmetrical loading.

Moreover, the attitude, configuration, interconnection and/or interrelation of the basic envelope and the stress relieving members is critical in fabrication and design of an air supported structure of substantially static equilibrium. It is thus a further object of this invention to provide various design formulations for construction of an air supported structure having substantially static equilibrium.

Other objects and advantages of the invention will become apparent from the following detailed description, taken in connection with the accompanying drawings, and in which drawings:

BRIEF DESCRIPTION OF THE DRAWINGS

FIG. 1 is a perspective view of an air supported structure which may comprise a stress relieved air supported structure according to my invention.

FIG. 2 is a top plan view of the air supported structure of FIG. 1.

FIG. 3 is an enlarged transverse sectional view taken substantially on the line 3—3 of FIG. 2 and showing a single membrane configuration.

FIG. 4 is a view similar to FIG. 3, but showing a multiple membrane configuration.

FIG. 9 is a fragmentary top plan view of a crown harness means which may be provided in the assembly of a stress relieved air supported structure according to my invention.

FIG. 10 is a top plan view of another form of air supported structure and which may comprise a stress relieved air supported structure according to my invention.

FIG. 11 is an enlarged fragmentary top plan view showing the interconnection and relationship of end harness means and ridge harness means which may comprise the crown harness of a stress relieved air supported structure as shown in FIG. 10.

DETAILED DESCRIPTION

Figures 5, 6, 7, 8:
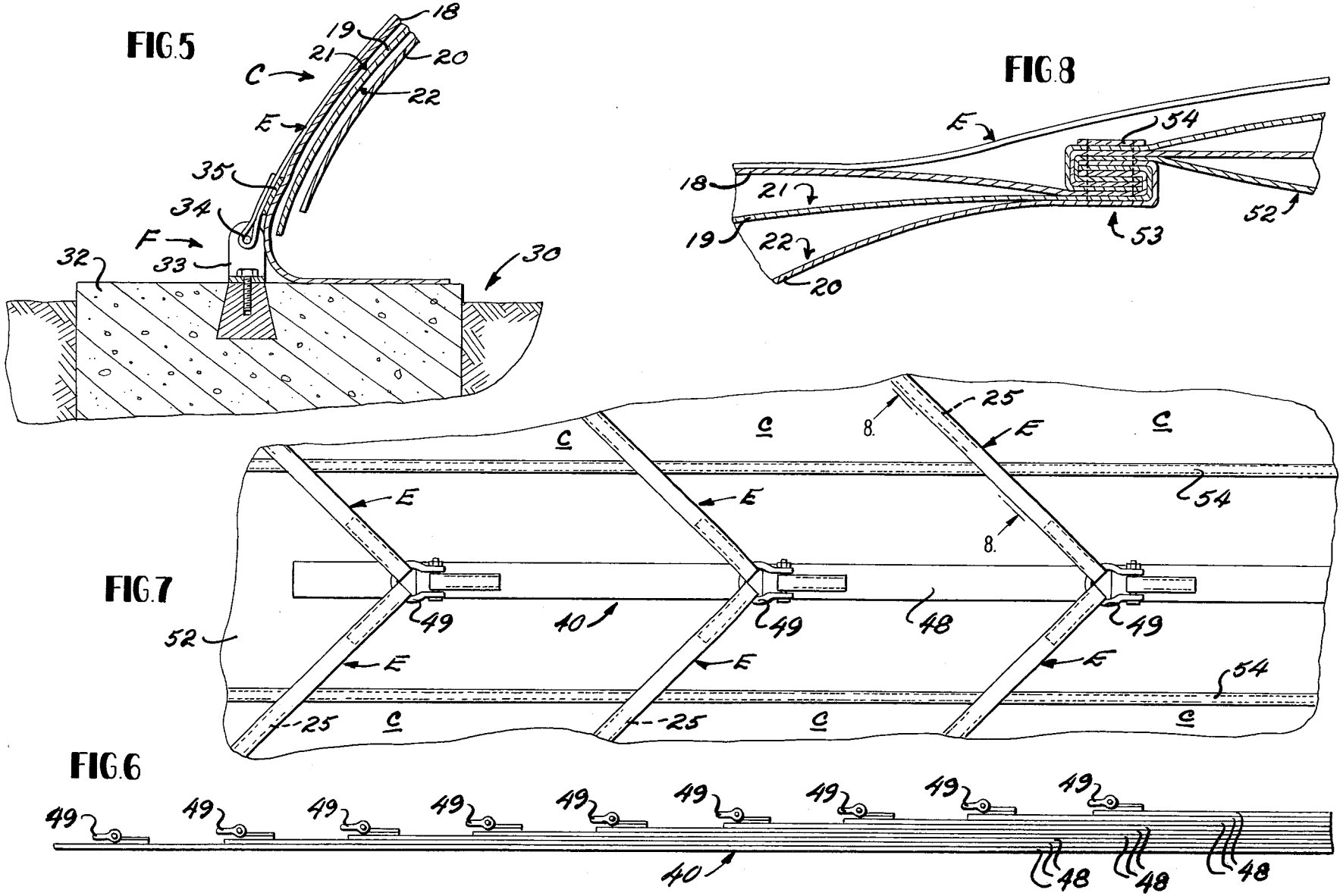
FIG. 5 is an enlarged fragmentary sectional view taken substantially on the line 4—4 of FIG. 1.
FIG. 6 is a side view of an end harness means which may be used in assembly of my improved stress relieved air supported structure.
FIG. 7 is an enlarged fragmentary sectional view showing attachment of the end section webs of a stress relieved air supported structure to an end harness means as shown in FIG. 6.
FIG. 8 is an enlarged fragmentary sectional view taken substantially on the line 8—8 of FIG. 7.

In the drawings, wherein similar reference characters are used to designate corresponding parts throughout the several views, and wherein are shown various embodiments of the invention, the letter A may generally designate a square ended air supported structure as shown in FIGS. 1 and 2 and B a round ended air supported structure as shown in FIG. 10. Air supported structure A preferably includes a wall portion comprising a plurality of panel members C which may be interconnected by seam means D and provided with web means E, some of which are selectively attached at each end thereof to anchor means F, and others of which are attached at one end thereof to anchor means F and at the other end thereof to crown harness means G. Air supported structure B preferably includes a wall portion comprising a plurality of panel members H which may be interconnected by seam means D and provided with web means K, some of which are selectively attached at each end thereof to anchor means F, and others of which are attached at one end thereof to anchor means F and at the other end thereof to crown harness means M.

Of course, the present invention is not restricted to use in either square ended or round ended air supported structures, but may obviously be used in air supported structures of various other designs. However, since the same will be most generally used in either square ended or round ended air supported structures, these two forms are shown and described.

Air supported structure A is generally of a polygonal floor plan, usually rectangular, and is preferably designed with the width thereof equal to or less than the length and the height equal to or less than one-half of the width. Some panel members C comprise a central portion 10 of air supported structure A and others comprise end sections 11 at each end thereof. Each end section 11 preferably comprises a pair of orthogonal corner members 12, each orthogonal corner member 12 including an end segment 13 and a side segment 14, adjacent end segments 13 thereof comprising an end closure portion for air supported structure A and side segments 14 thereof adjoining central portion 10.

Panel members C may be of any desired membrane configuration. They may selectively be of a single membrane configuration 16, as shown in FIG. 3, or may be comprised of a multiple membrane configuration, such as the triple membrane configuration, as shown in FIG. 4, which includes an outer membrane 18, a center membrane 19, and an inner membrane 20, there being provided a substantially dead air space 21 between outer membrane 18 and center membrane 19, and a substantially dead air space 22 between inner membrane 20 and center membrane 19.

In each instance, the membrane configuration comprising the exterior surface of an air supported structure A is preferably configured to provide an exterior volute surface 23.

Adjoining panel members C are preferably interconnected together by seam means D. Seam means D may be formed by an interlocking folding together of the side edges of the membrane configurations of adjoining panel members C. Thus, each seam means D will include a given running width of each membrane configuration of adjoining and interconnected panel members C; the membrane configuration making up such seam means will be of a given cross-sectional area; and each membrane configuration making up such seam means will have a given modulus of elasticity.

Consideration of the modulus of elasticity of the membrane configurations making up a given seam means is important to provision of a seam means having structural integrity, and the same must be selected in order to accommodate at least a given minimum seam means load without rupturing. This becomes a factor of consideration when, for instance, adjoining and interconnected single membrane configurations are of different materials, or different coatings are applied thereto, so that the modulus of elasticity of one membrane configuration is not the same as the other, which would perhaps be unusual, since the single membrane configurations of a given air supported structure are generally the same; and will be usually encountered and must therefore almost always be resolved in the case of interconnected multiple membrane configurations, in which the various membrane configurations of a given panel member will usually be of differing materials and/or have differing coatings applied thereto, so that each has a modulus of elasticity which differs from the other or others. In fact, the use of a multiple membrane configuration in which each has the same structural substrate, but with various different coatings applied to each, is not unusual but is, in fact, the preferred construction in providing an air supported structure having optimum heat flow properties, sound and light radiation, and weather resistance.

Web means E is preferably interconnected along each seam means D such as by double stitching rows 25. Web means E thus relieves the stress of seam means D and provides for resolution of stress from the membrane configuration of panel members C through seam means D and thence to web means E.

As shown in FIG. 5, the lowermost end of each panel member C is positioned adjacent ground line 30 by anchor means F. Anchor means F may include an anchor slab, such as a concrete block 32, within which may be countersunk or otherwise attached a bifurcated connecting element 33 having a cross piece 34 about which may be looped the lowermost end of the web means E provided along seam means D of adjoining panel members C.

In the triple membrane configuration of FIG. 4, which is a preferred membrane configuration for an air supported structure, the membranes thereof are preferably terminated adjacent the ground line in a stepped relation, with inner membrane 20 terminating above the ground line, central membrane 19 terminating below the end of membrane 20, but still above the ground line, and outer membrane 22 being provided to trail along the ground line. Air is thus permitted to enter the dead air spaces 21 and 22 thereof, in a manner to permit catenary separation thereof in providing a substantially dead air space between the membrane configurations thereof. A reinforcing web 35 may be attached transversely across panel member C, adjacent the ground line, for strengthening panel member C adjacent the point of interconnection of web means E thereof to anchor means F. Reinforcing web 35 serves to restrain the hoop stresses within panel member C and resolves the same directly to web means E, which is interconnected to reinforcing web 35 adjacent anchor means F.

Neither seam means D nor web means E of panel members C of central portion 10 are attached to crown harness G. Such panel members C are positioned with the web means E thereof interconnected to opposed anchor means F at opposite sides of air supported structure A.

The horizontal or fill stresses of each panel member C of central portion 10 are transmitted to the web means E interconnected thereto, which are then resolved in the hoop direction of the web means E to an anchor means F. The hoop stresses induced in such panel members C are transmitted to the reinforcing webs 35 thereof and thence through web means E to anchor means F. It may be pointed out that, since each such panel member C is allowed to become torroidal in nature, rather than remaining cylindrical, the hoop stresses induced within the membrane configuration thereof are considerably less than would be the case if each such panel member C was not allowed to volute.

Central portion 10 is preferably configured in a manner so that the total seam means load ($\delta w$) (pounds) of each seam means thereof comprises substantially:

$$\sigma w = \frac{(VH)^2 + 0.25(VW)^2}{149.19H}$$

wherein:

V is the design wind velocity of the air supported structure (MPH),

H is the height of the air supported structure (feet),

L is the length of the air supported structure (feet) and

W is the width of the air supported structure (feet); and within the design limits of:

$V \leqq 120$ MPH
$H \leqq W/2$
$W \leqq L$ and so that the total anchor load ($\delta a$) (pounds) of each anchor means of each web means of the central portion comprises substantially:

$$\sigma a = \frac{(VH)^2 + 0.25(VW)^2}{142.06H}$$

Figure 12:
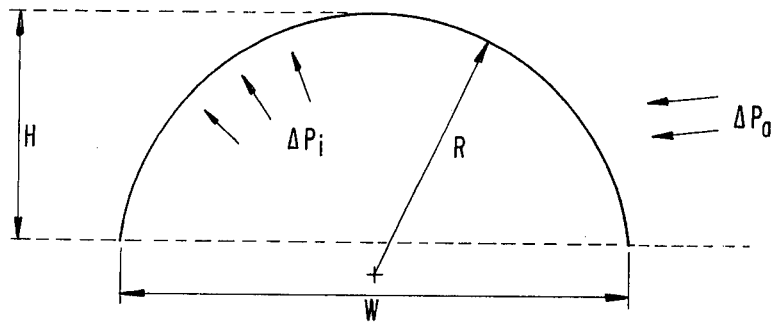
FIG. 12 is a diagram illustrating the primary parameters of the present invention with respect to air supported structure loads.

The primary parameters used in defining air supported structure loads are graphically illustrated in FIG. 12. That is, the design wind speed (V) from which flows the aerodynamic impact pressure ($\Delta P_a$) and the inflation pressure ($\Delta P_i$). This is then combined with the structural geometry of the air supported structure. That is, the primary radius R which is expressed in terms of the height H and the width W. Note that the results are independent of the length L of the structure except that the width is limited in relation to the length. It may be noted that a further design limitation is that the design wind speed V maximum is 120 m.p.h.

Crown harness means G preferably includes end harness means 40, one for each orthogonal corner member 12 of each end section 11, and ridge harness means 43. Crown harness means G basically comprises a "double Y" construction, ridge harness means 43 preferably comprising an elongated strap means 45 extending longitudinally along the apex of air supported structure A from one end section 11 thereof to the other, and including ring fastener means 46 at each end thereof; each end harness means 40 including a plurality of strap means 48 which are interconnected together to co-extend substantially linearly along an orthogonal corner member 12 at the apex of intersection of end segment 13 and side segment 14 thereof, each strap means 48 thereof having a fastener means 49 attached adjacent the lowermost end thereof and the uppermost end of all such strap means being attached to shackle means 50, which is interconnected to a ring fastener means 46 at one end of ridge harness means 43.

Each end segment 13 preferably includes a plurality of panel members C of increasing graduated length from the cornermost one thereof to the longitudinal axis of air supported structure A, where one end segment 13 adjoins the other end segment 13 and comprises an end of air supported structure A; and each side segment 14 preferably includes a plurality of panel members C of increasing graduated length from the cornermost one thereof to interconnection thereof with the adjoining end panel member C of central portion 10. A corner panel member 52 is preferably interconnected to and along the uppermost reaches of panel members C of each end segment 13 and side segment 14 of an orthogonal corner member 12, being attached thereto such as by a seam 53, along which may be attached a web 54. In this manner end sections 11 comprise an end closure portion at each end of air supported structure A.

Panel members C of end segment 13 and side segment 14 of an orthogonal corner member 12 are preferably symmetrically arranged with substantially dimensionally corresponding panel members C so that, as shown in FIG. 1, the cornermost panel member a of end segment 13 thereof substantially dimensionally corresponds to cornermost panel member *a'* of side segment 14 thereof; panel member *b* of end segment 13 thereof substantially dimensionally corresponds to panel member *b'* of side segment 14 thereof; etc. Web means E of such corresponding panel members of end segment 13 and side segment 14 of an orthogonal corner member 12 are preferably interconnected at one end thereof to anchor means F and at the other end thereof to a common fastener means 49.

As shown in FIGS. 6 and7, and 7, means E of corresponding panel members C of end segment 13 and side segment 14 of each orthogonal corner member 12 are preferably attached to and along seam means D thereof to a point adjacent the seam 53 thereof which adjoins the same to a corner panel member 52, extending over seam 53 and a portion of such corner panel member 52 to attachment thereof to fastener means 49 of strap means 48 of an end harness means 40, thus being unconnected to both seam 53 and corner panel member 52. Corner panel members 52 are thus stress relieved in that the loads of panel members C adjoining the same are direct, through web means E thereof to end harness means 40 and not through corner panel members 52. Further, since each seam 53 adjoining a corner panel member to a panel member C is so relatively short and is stress relieved by web means E of such panel members C, the seam load thereof is minimal and need not be individually accounted for in configuring the air supported structure for structural stability.

Since the cornermost corresponding panel members C of end segment 13 and side segment 14 of an orthogonal corner member 12 (panel members *a* and *a'*) cover only a relatively small area and thus have only slight stress and load factors, and extend for only a relatively small distance above anchor means F, it is not necessary to attach the web means E thereof which extends along seam means D adjoining the same to the next adjacent panel member C thereof (*b* and *b'* of FIG. 1). Thus, strap means 48 of the end harness means 40 for orthogonal corner members 12 may terminate short thereof. Of course, such omission of interconnection is not critical and strap means 48 of end harness means 40 could include segments interconnected to the web means E of all corresponding panel members C of end segment 13 and side segment 14 of an orthogonal corner member 12.

The membrane configuration of each panel member C of end segment 13 and side segment 14 of an orthogonal corner member 12 will transmit the inflation and aerodynamic load vectors thereof to seam means D interconnecting the same to an adjoining panel member C and thence to web means E which is interconnected to and extends along such seam means D, such load being divided, so that part of the induced loading is directed to the anchor means F to which such web means E is attached and partly to strap means 48 through interconnection of such web means E to fastener mens 49 thereof. Strap means 48 is maintained in lateral equilibrium by the equalizing load resolution resulting from common attachment thereto of web means E of corresponding panel members C of end segment 13 and side segment 14 of an orthogonal corner member 12, the resultants of such web means loads thus flowing into and along strap means 48 without displacing it The loads applied to and flowing into strap means 48 are not equal along the length thereof, as is the case in connection with loading of web means E, and therefore such load cannot be partly resolved at an anchorage point along the ground line. The load resultants of strap means 48 of an end harness means 40 comprise the total end harness means load which is transmitted through end harness means 40 and into ridge harness means 43 by interconnection of end harness means 40 to ring fastener means 46 of ridge harness means 43. Ridge harness means 43 is maintained in lateral equilibrium by the equalizing load resolution resulting from common attachment thereto of the end harness means 40 of both orthogonal corner members 12 which comprise an end section 11.

Since substantially equal loading conditions exist at both ends of air supported structure A, and since the same are substantially opposite in nature, interconnection at opposite ends thereof of the end harness means of end sections 11 comprises a load resolution which provides a condition of static equilibrium of air supported structure A.

The importance of crown harness means G becomes obvious if we consider the result of removing the same from air supported structure A. If removed, the accumulation of loads of panel members C of each end section 11 would have to be resolved by and through the panel members C of central portion 10. The membrane configurations of panel members C of central portion 10 would thus be very highly stressed so as to substantially straighten out the preferred volute configuration thereof, causing the structural envelope of air supported structure A to substantially lose its stress relieving qualities and act as a flat single stressed skin carrying much higher loads than are necessary and/or advisable if structural integrity is to be maintained.

Accordingly, the stress relieving system embodied in the present invention is such as to act in concert with the fabric elongation characteristics of the membrane configurations thereof, permitting and indeed aiding appropriate contouring thereof, serves as a "rip-stop" along the edges of each panel member C thereof, and considerably decreases the stresses which would normally have to be carried by the outer structural envelope of an air supported structure.

Such construction thus permits the use of membrane configurations which have heretofore been unusable in large air supported structures, either because of their low strength characteristics or because of an inability to accurately predict the structural integrity of a membrane configuration having various coatings applied thereto.

Figure 17:
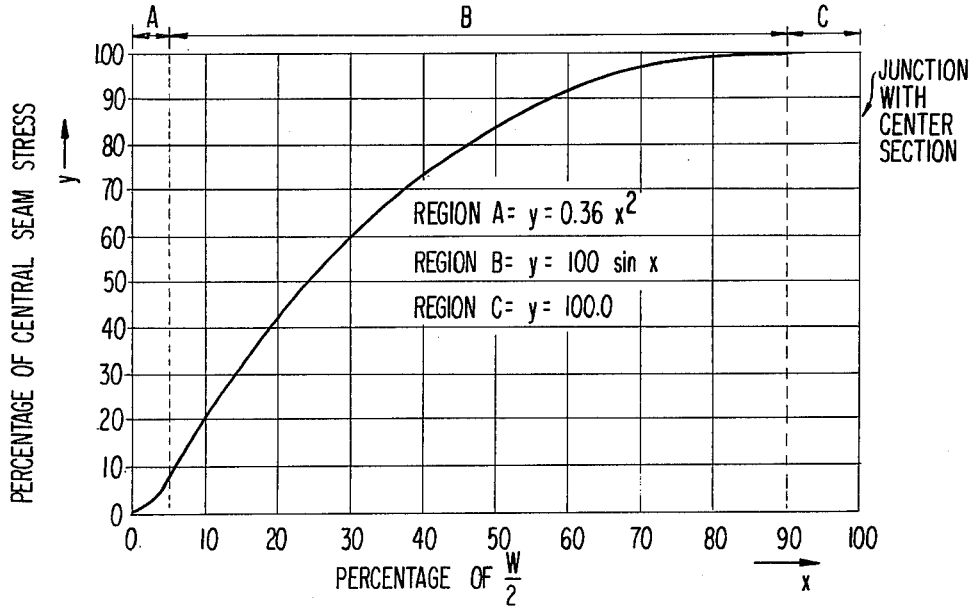
FIG. 17 is a graph showing the application of certain formulae in determining the approximate seam stresses of given seams along a square ended air supported structure.

In configuring end section 11 to provide structural integrity, the total seam means load ($\delta w'$) (pounds) of each seam means D of end section 11 and the total anchor load ($\delta a'$) (pounds) of the anchor means for each web means E of each end section 11 may be respectively expressed as a percentage of the total seam means load ($\delta w$) of a seam means D of central portion 10 and a percentage of the total anchor means load ($\delta a$) of an anchor means of a web means E of central portion 10. In this regard, neither the total seam means load ($\delta w'$) nor the total anchor means load ($\delta a'$) of an end section are uniform. They may, however, be determined for various regions thereof as a percentage ($x$) of the half width (W/2) of the particular end segment 13 or side segment 14 in which they are located, as diagrammatically illustrated in FIG. 2. Referring to the graph of FIG. 17, and wherein ($y$) is expressed as a percentage of the stress of the corresponding member of central portion 10:

The total seam means load ($\delta w'$) (pounds) of each said seam means of each said end closure portion comprises substantially:

$\delta w' = y(\delta w)$ wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein:

$x$ is the percentage of half width of the structure (W/2) measured from the orthogonal corner in plan, and also wherein:

$\delta w$ is the total seam means load of a seam means of central portion 10 and:

The total anchor load ($\delta a'$) (pounds) of said anchor means for each said web means of each said end closure portion comprises substantially:

$\delta a' = y(\delta a)$ wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein;

$x$ is the percentage of half width of the structure (W/2) measured from the orthogonal corner in plan; and also wherein:

$\delta a$ is the total anchor load of an anchor means F of a web means E of central portion 10.

The membrane configuration of the panel members H of air supported structure B may be the same as that previously described in connection with air supported structure A. Accordingly, the membrane configurations as shown in FIGS. 3 and 4 and as otherwise described in connection with air supported structure A may comprise the panel members H of air supported structure B and no further showing and/or description thereof is deemed necessary in connection with air supported structure B.

In this regard, it may be noted that adjoining panel members H of air supported structure B may be interconnected together by seam means identical to seam means D which has been shown and described in connection with air supported structure A. Accordingly, for convenience of reference, the seam means of air supported structure B is also described as comprising seam means D. It may also be noted that web means K of air supported structure B are interconnected to seam means D thereof in the same manner as previously shown and described in connection with web means E of air supported structure A to seam means D thereof.

Similarly, anchor means F of air supported structure A, as shown in FIG. 5 and as otherwise shown and described in connection with air supported structure A may likewise comprise the anchor means of air supported structure B. Accordingly, the anchor means of air supported structure B is also described as anchor means F.

Air supported structure B is generally of a polygonal floor plan similar to air supported structure A, except that the same has semi-hemispherical end closure portions or end sections 55 (which is, for all practical purposes, the only difference between air supported structure A and air supported structure B). Air supported structure B is also preferably designed with the width thereof equal to or less than the length and the height thereof equal to or less than one-half the width. Some panel members H may comprise a central portion 57 of air supported structure B, others comprising end sections 55 at each end thereof.

The construction and configuration of central portion 57 of air supported structure B will be the same as that previously described in connection with central portion 10 of air supported structure A. The same will thus preferably embody the same load and stress relationships previously described in connection with central portion 10 of air supported structure A and web means K of air supported structure B will serve to resolve the various load and stress resultants of central portion 57 of air supported structure B in the same manner as previously described in connection with web means E of central portion 10 of air supported structure A.

Crown harness means M preferably includes end harness means 60 for each end section 55 thereof and ridge harness means 62.

Ridge harness means 62 preferably comprises an elongated strap means extending longitudinally along the apex of air supported structure B, from one end section 55 thereof to the other, and including ring fastener means 63 at each end thereof.

End harness means 60 are comprised of web means K which are interconnected to the seam means which interconnect adjoining panel members H of end sections 55. Web means K which comprise end harness means 60 are each attached to an anchor means adjacent the ground line and are provided at their uppermost end with shackle means 65 which may be interconnected to a ring fastener means 63 at one end of ridge harness means 62.

Panel members H of end sections 55 are preferably symmetrically arranged in a radially extending relation from each end of central portion 57. Accordingly, the loads and stresses of panel members H, the seam means joining the same together and the web means K thereof are substantially equal throughout each end section 55. In this regard, the membrane configuration of each panel member H of an end section 55 will transmit the inflation and aerodynamic load vectors thereof to the seam means interconnecting the same to an adjoining panel member H, and thence to web means K which is interconnected to and extends along such seam means, such load being divided along web means K, part of the induced loading being directed to the anchor means to which such web means K is attached and part upwardly through web means K to ridge means 62, through interconnection therewith to fastener means 63 of ridge means 62.

Ridge means 62 is maintained in lateral equilibrium by the equalizing load resolution resulting from common attachment thereto of radially extending end harness means 60.

Since substantially equal loading conditions exist at both ends of air supported structure B, and since the same are substantially opposite in nature, interconnection at opposite ends thereof of end harness means 60 of end section 55 comprises a load resolution which provides a condition of static equilibrium of air supported structure B.

Crown harness means M of air supported structure B is important to the stress relieving system embodied by air supported structure B in the same manner as previously described in connection with crown harness means G of air supported structure A.

The parts thereof being symmetrically arranged and interconnected, end sections 55 of air supported structure B may be rather easily configured to provide structural integrity. In this regard:

The total seam means load ($\delta w'$) (pounds) of each seam means of each end closure portion 55 comprises substantially:

$$\sigma w' = \frac{\sigma w}{2}$$

wherein:

$\delta w$ comprises the total seam means load of a seam means of central portion 57:

and:

The total anchor load ($\delta a'$) (pounds) of the anchor means for each web means K of each end closure portion 55 comprises substantially:

$$\sigma a' = \frac{\sigma a}{2}$$

wherein:

$\delta a$ comprises the total anchor load of an anchor means for a web means K of central portion 57.

The crown harness load (N) of crown harness means G of air supported structure A and crown harness means M of air supported structure B are substantially identical. Accordingly, the crown harness means of each may be configured as a function of the design wind velocity (V) of the air supported structure and the height (H) and width (W) thereof, the same comprising substantially:

$$N = \frac{(VH)^2 + 0.25(VW)^2}{7.33198H}$$

within the design limits of:

$V \leqq 120$ MPH
$H \leqq W/2$
$W \leqq L$.

Figure 13:
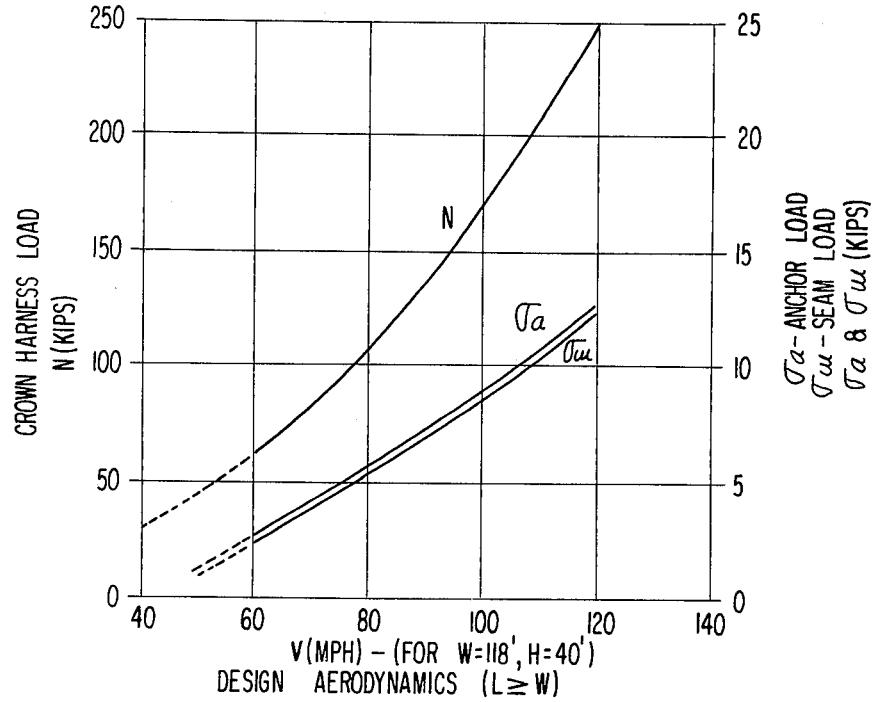
FIG. 13 is a graph showing the relationship of crown harness load, anchor load, and seam load as resultants of design aerodynamics for a given air supported structure.
Figure 14:
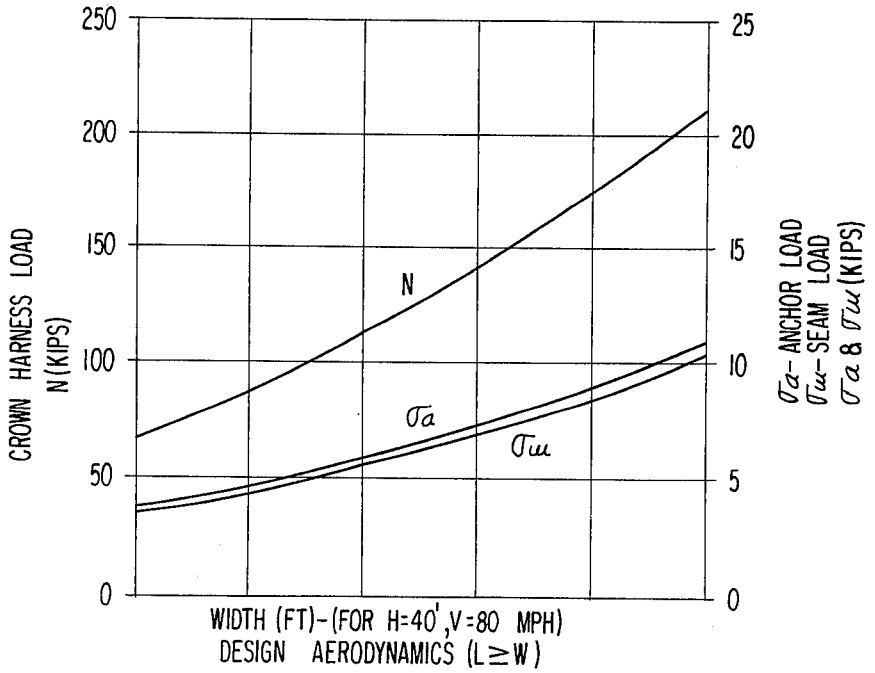
FIG. 14 is a graph showing the relationship of crown harness load, anchor load and seam load as resultants of a given aerodynamic force in relation to the width of the air supported structure.
Figure 15:
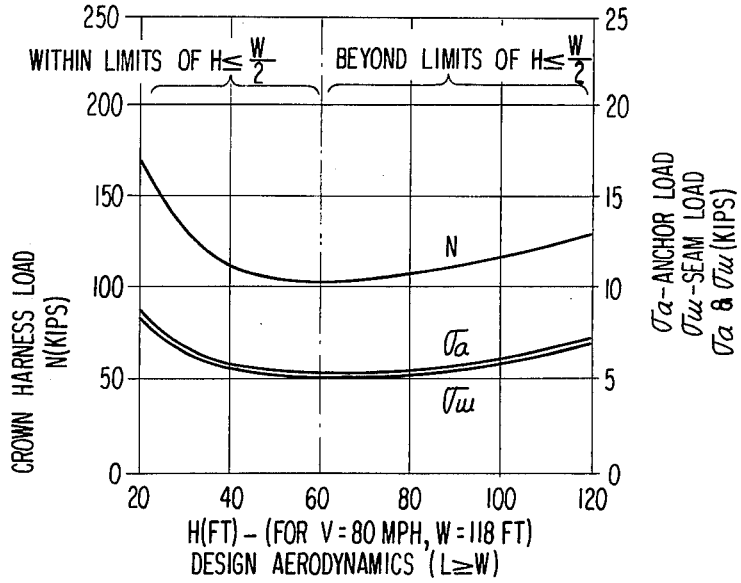
FIG. 15 is a graph showing the relationship of crown harness load, anchor load and seam load as resultants of aerodynamic forces in relation to the height of the air supported structure.

The graphs of FIGs. 13, 14 and 15 illustrate the relationships of the crown harness load (N), seam means load ($\delta w$) and total anchor load ($\delta a$) as resultants of the design aerodynamics of a given air supported structure, FIG. 13 illustrating the increase of crown harness load, seam load and anchor load as aerodynamic loading increases for an air supported structure of given width and height; FIG. 14 illustrating the relationship thereof as resultants of aerodynamic forces under given aerodynamic loading and having a given height in relation to the width of the air supported structure; and FIG. 15 illustrating the resultants of aerodynamic forces for given aerodynamic loading of an air supported structure of a given width in relation to the height thereof, one section thereof expressed as being within the limits of the height thereof being equal to or less than half of thb width thereof, and the other portion thereof expressed as being beyond the limits of the height thereof being equal to or less than one-half of the width.

In order to provide a clear demarcation as between the configurations relative to the central portion of the air supported structure and the end closure portions of an air supported structure, the total seam means load with respect to the central portion have heretofore been respectively set forth as ($\delta w$) and, with respect to the end closure portion, the total seam means load set forth as ($\delta w'$). However, in determining membrane configuration relative to the total membrane configuration load ($N_S$). resultant stresses of a membrane configuration ($n_\theta$), and total web means load ($N_W$), it is obvious that the same will be designed either as a part of the central portion or as a part of an end closure portion. Accordingly, as used herein with respect to determination of such configurations, the designation ($\delta w$) will be used with respect to the total seam means load of a given seam means, whether as a seam means of the central portion or of an end closure portion.

Figure 16:
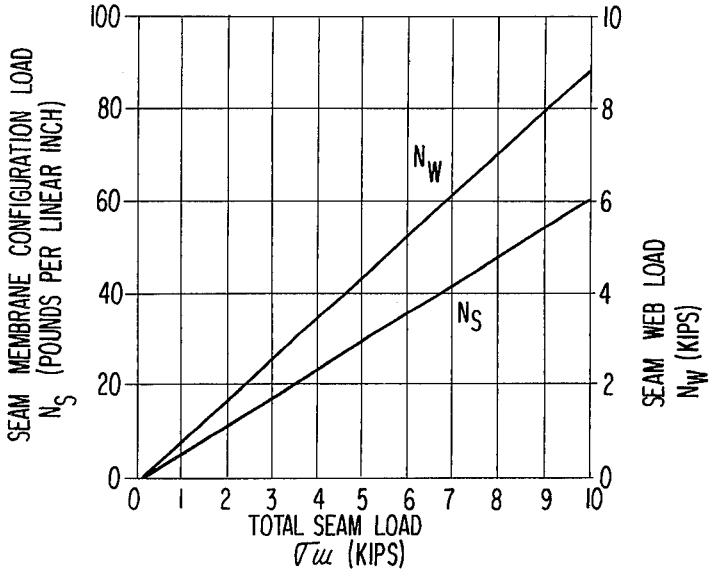
FIG. 16 is a graph showing the relationship of the seam membrane configuration load and seam web load with respect to the total seam load of the air supported structure.

The graph of FIG. 16 illustrates the relationship of the total membrane configuration load ($N_S$), total web means load ($N_W$) and total seam means load ($\delta w$), the preferred configuration being such that:

$$N_S + N_W = \delta w$$

In the configuring of a single membrane or multiple membrane air supported structure to provide structural integrity, the same should preferably be configured so that the total membrane configuration load ($N_S$) (pounds per inch) of the membrane configuration of a given seam means comprises substantially:

$$N_S = \frac{(\sigma w)(A_F E_F)}{b(A_F E_F + A_W E_W)}$$

wherein:

$\delta w$ is the total seam means load of such given seam means (pounds),
$b$ is the total running width of the membrane configurations within such given seam means (inches),
$A_W$ is the cross sectional area of the web means interconnected to and along such given seam means (square inches),
$A_F$ is the cross sectional area of the membrane configurations in such given seam means (square inches),
$E_W$ is the modulus of elasticity of the web means interconnected to and along such given seam means, and
$E_F$ is the modulus of elasticity of the membrane configurations of such given seam means; and within the design limits of:

$V \leqq 120$ MPH
$H \leqq W/2$
$W \leqq L$, and wherein:

V is the design wind velocity of the air supported structure (MPH),
H is the height of the air supported structure (feet),
L is the length of the air supported structure (feet), and
W is the width of the air supported structure (feet).

In configuration of the seam web means to provide structural integrity for the air supported structure, the same is preferably configured so that the total seam web means load ($N_W$) (KIPS) of a given seam means comprises substantially:

$$N_W = \frac{(\sigma w)(A_W E_W)}{A_W E_W + A_F E_F}$$

wherein:

$\delta w$ is the total seam means load of such given seam means (pounds),
$A_W$ is the cross sectional area of the web means interconnected to and along such given seam means (square inches),
$A_F$ is the cross sectional area of the membrane configurations in such given seam means (square inches),
$E_W$ is the modulus of elasticity of the web means interconnected to and along such given seam means, and
$E_F$ is the modulus of elasticity of the membrane configurations of each given seam means; and within the design limits of:

$V \leqq 120$ MPH
$H \leqq W/2$
$W \leqq L$, and wherein:

V is the design wind velocity of the air supported (MPH).

H is the height of the air supported structure (feet),

L is the length of the air supported structure (feet), and

W is the width of the air supported structure (feet).

In certain instances, particularly where various coatings are used thereon to provide optimum weather resistance, heat transfer and light distribution, the membrane configurations of a multiple membrane air supported structure will have differing moduluses of elasticity. Thus, in order to provide an air supported structure having structural integrity, the total membrane configuration load ($N_S$) (pounds per inch) of the membrane configurations of each seam means thereof preferably comprises substantially:

$$N_S = \frac{\sigma w(x)}{b(x + A_W E_W)}$$

wherein:

$\delta w$ is the total seam means load of such given seam means (pounds), $b$ is the total running width of the membrane configurations within such given seam means (inches), $A_W$ is the cross sectional area of the web means of such given seam means (square inches), $E_W$ is the modulus of elasticity of the web means of such given seam means (p.s.i.), and $$x = \frac{A_F{}^1E_F{}^1 + A_F{}^2E_F{}^2 + \ldots A_F{}^nE_F{}^n}{\Sigma m}$$

wherein:

$A_F{}^1, A_F{}^2 \ldots A_F{}^n$ is the cross sectional area of each respective membrane configuration of such given seam means (square inches), $E_F{}^1, E_F{}^2 \ldots E_F{}^n$ is the modulus of elasticity of each respective membrane configuration of each given seam means (p.s.i.), and $\epsilon m$ is the number of types of membrane configurations within such given seam means; and within the design limits of:

$V \leqq 120$ MPH $H \leqq W/2$ $W \leqq L$ and wherein:

V is the design wind velocity of the air supported structure (MPH),

H is the height of the air supported structure (feet),

L is the length of the air supported structure (feet), and

W is the width of the air supported structure (feet).

In an air supported structure including a multiple membrane configuration in which the membranes thereof are of different moduluses of elasticity, the same are preferably configured so that the total membrane configuration load ($N_S{}^1, N_S{}^2 \ldots N_S{}^n$) (pounds) of each such membrane configuration of each such given seam means comprises substantially:

$$N_S{}^1 = \frac{N_S(A_F{}^1E_F{}^1)}{A_F{}^1E_F{}^1 + A_F{}^2E_F{}^2 \ldots A_F{}^nE_F{}^n}$$

$$N_S{}^2 = \frac{N_S(A_F{}^2E_F{}^2)}{A_F{}^1E_F{}^1 + A_F{}^2E_F{}^2 \ldots A_F{}^nE_F{}^n}$$

-continued $$N_S{}^n = \frac{N_S(A_F{}^nE_F{}^n)}{A_F{}^1E_F{}^1 + A_F{}^2E_F{}^2 \ldots A_F{}^nE_F{}^n}$$

Further, in providing structural integrity in such a multiple membrane air supported structure, the same are preferably configured so that the stress in each such membrane configuration ($N_\theta{}^1, N_\theta{}^2 \ldots N_\theta{}^n$) (pounds per inch) of each given seam means thereof comprises substantially:

$$N_\theta{}^1 = \frac{N_S{}^1}{b^1}$$

$$N_\theta{}^2 = \frac{N_S{}^2}{b^2}$$

$$N_\theta{}^n = \frac{N_S{}^n}{b^n}$$

wherein:

$b^1, b^2 \ldots b^n$ is the total running width of each such membrane configuration within such given seam means (inches).

Various changes in the forms of the invention herein shown and described may be made without departing from the spirit of the invention and the scope of the following claims:

I claim:

1. An air supported structure having a wall portion including a plurality of relatively elongated panel members joined together by seam means; anchor means being provided along the base perimeter of said wall portion; said panel members including a membrane configuration defining at least an exterior volute surface along said wall portion, and having web means interconnected thereto along said seam means; said wall portion having a relatively elongate central portion provided with an end closure portion at each end thereof; said central portion including a plurality of said panel members, said web means of said seam means interconnecting said panel members of said central portion extending transversely about said central portion and being attached to said anchor means along the base perimeter of said central portion at opposed sides of said central portion; crown harness means including an end harness means for each said end closure portion and ridge harness means; each said end closure portion including a plurality of said panel members, said web means of said seam means interconnecting said panel members of each said end closure portion being respectively attached to said anchor means along the base perimeter of an end closure portion and attached in situ as a part of an end harness means of such end closure portion; said ridge harness means extending along and adjacent the apex of said central portion, in an overlying and unattached relation to said panel members of said central section and being unattached to said panel members of each said end closure portion; each said end harness means being unattached to said membrane configuration and seam means of the end closure portion for which the same is provided at at least the area of attachment thereto in situ as a part of said web means of said end closure portion for which the same is provided and being unattached to said panel members of said central portion; wherein the radius of curvature of said panel members is a direct geometric function of the width and height of said air supported structure; wherein the loads in said crown harness are a function of the end closure means and end harness means in relation to the width and height of said air supported structure, the primary radius of curvature thereof, and the design wind speed and inflation pressure thereof; wherein the loads in said anchor means are a function of the loads in said seam means; and wherein the loads in said seam means are a function of the geometry of the respective portion thereof of which they are a part, the primary radius of curvature thereof, and the design wind speed and inflation pressure thereof.

2. An air supported structure as specified in claim 1 wherein the crown harness load (N) (pounds) configuration of said crown harness means comprises at least substantially:

$$N = \frac{(VH)^2 + 0.25(VW)^2}{7.33198H}$$

wherein:

V is the design wind velocity of the air supported structure (MPH),

H is the height of the air supported structure (feet), L is the length of the air supported structure (feet), and W is the width of the air supported structure (feet);

and within the design limits of:

$V \leqq 120$ MPH $H \leqq W/2$ $W \leqq L$.

3. An air supported structure as specified in claim 1 wherein the total seam web means load ($N_W$) (KIPS) configuration of a given seam means comprises at least substantially:

$$N_W = \frac{(\sigma w)(A_W E_W)}{A_W E_W + A_F E_F}$$

wherein:

$\delta w$ is the total seam means load of such given seam means (pounds), $A_W$ is the cross sectional area of the web means interconnected to and along such given seam means (square inches), $A_F$ is the cross sectional area of the membrane configurations in such given seam means (square inches), $E_W$ is the modulus of elasticity of the web means interconnected to and along such given seam means, and $E_F$ is the modulus of elasticity of the membrane configurations of such given seam means; and within the design limits of:

$V \leqq 120$ MPH $H \leqq W/2$ $W \leqq L$ and wherein:

V is the design wind velocity of the air supported structure (MPH),

H is the height of the air supported structure (feet), L is the length of the air supported structure (feet), and W is the width of the air supported structure (feet).

4. An air supported structure as specified in claim 1 wherein the total membrane load ($N_S$) (pounds per inch) configuration of the membrane configurations of a given seam means comprises at least substantially:

$$N_S = \frac{(\sigma w)(A_F E_F)}{b(A_F E_F + A_W E_W)}$$

wherein:

$\delta w$ is the total seam means load of such given seam means (pounds), $b$ is the total running width of the membrane configurations within such given seam means (inches), $A_W$ is the cross sectional area of the web means interconnected to and along such given seam means (square inches), $A_F$ is the cross sectional area of the membrane configurations in such given seam means (square inches), $E_W$ is the modulus of elasticity of the web means interconnected to and along such given seam means, and $E_F$ is the modulus of elasticity of the membrane configurations of such given seam means; and within the design limits of:

$V \leqq 120$ MPH $H \leqq W/2$ $W \leqq L$ and wherein:

V is the design wind velocity of the air supported structure (MPH),

H is the height of the air supported structure (feet), L is the length of the air supported structure (feet), and W is the width of the air supported structure (feet).

5. An air supported structure as specified in claim 4 wherein the stress configuration of the membrane configurations ($N_\theta$) (pounds per inch) of such given seam means comprises at least substantially:

$$N\Theta = \frac{N_S}{b}.$$

6. An air supported structure as specified in claim 1 wherein the total anchor load ($\delta a$) (pounds) configuration of said anchor means for each said web means of said central portion comprises at least substantially:

$$\sigma a = \frac{(VH)^2 + 0.25(VW)^2}{142.06H}$$

7. An air supported structure as specified in claim 6 wherein the total anchor load ($\delta a'$) (pounds) configuration of said anchor means for each said web means of each said end closure portion comprises at least substantially:

$$\delta a' = y(\delta a)$$

wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein:

$x$ is the percentage of half width of the structure (W/2) measured from the orthogonal corner in plan.

8. An air supported structure as specified in claim 1 wherein at least certain of said panel members are interconnected by given seam means and wherein:

$$N_S + N_W = \delta w$$

wherein:

$N_S$ is the total membrane load (pounds per inch) configuration of the membrane configurations of each such given seam means and comprises at least substantially:

$$N_S = \frac{\sigma w(x)}{b(A_F E_F + A_W E_W)}$$

wherein:

$\delta w$ is the total seam means load of such given seam means (pounds), $b$ is the total running width of the membrane configurations within such given seam means (inches), $A_W$ is the cross sectional area of the web means of such given seam means (square inches), $E_W$ is the modulus of elasticity of the web means of such given seam means (p.s.i.), wherein:

$A_F$ is the cross sectional area of the membrane configurations within such given seam means (square inches), $E_F$ is the modulus of elasticity of the membrane configurations of such given seam means (p.s.i.), wherein:

$N_W$ is the total seam web load (KIPS) configuration of each such given seam means and comprises at least substantially:

$$N_W = \frac{(\sigma w)(A_W E_W)}{A_W E_W + A_F E_F}$$

and within the design limits of:

$V \leqq 120$ MPH $H \leqq W/2$ $W \leqq L$ and wherein:

V is the design wind velocity of the air supported structure (MPH),

H is the height of the air supported structure (feet), L is the length of the air supported structure (feet), and W is the width of the air supported structure (feet).

9. An air supported structure as specified in claim 8 wherein the stress configuration of the membrane configurations ($N_\theta$) (pounds per inch) of such given seam means comprises at least substantially:

$$N\Theta = \frac{N_S}{b}.$$

10. An air supported structure as specified in claim 1 wherein the total seam means load ($\delta w$) (pounds) configuration of each said seam means of said central portion comprises at least substantially:

$$\sigma w = \frac{(VH)^2 + 0.25(VW)^2}{149.19H}$$

wherein:

V is the design wind velocity of the air supported structure (MPH),

H is the height of the air supported structure (feet), L is the length of the air supported structure (feet), and W is the width of the air supported structure (feet): and within the design limits of:

$V \leqq 120$ MPH $H \leqq W/2$ $W \leqq L$.

11. An air supported structure as specified in claim 10 wherein the total anchor load ($\delta a'$) (pounds) configuration of said anchor means for each said web means of each said end closure portion comprises at least substantially:

$$\sigma a' = \frac{\sigma a}{2}$$

wherein:

V is the design wind velocity of the air supported structure (MPH),

H is the height of the air supported structure (feet), L is the length of the air supported structure (feet), and W is the width of the air supported structure (feet); and within the design limits of:

$V \leqq 120$ MPH $H \leqq W/2$ $W \leqq L$.

12. An air supported structure as specified in claim 10 wherein the total seam means load ($\delta w'$) (pounds) configuration of each said seam means of each said end closure portion comprises at least substantially:

$$\delta w' = y(\delta w)$$

wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein:

$x$ is the percentage of half width of the structure (W/2) measured from the orthogonal corner in plan.

13. An air supported structure as specified in claim 10 wherein the total seam means load ($\delta w'$) (pounds) configuration of each said seam means of each said end closure portion comprises at least substantially:

$$\sigma w' = \frac{\sigma w}{2}.$$

14. An air supported structure as specified in claim 1 wherein at least certain of said panel members comprise a plurality of membrane configurations and at least certain of such panel members are interconnected by given seam means and wherein:

$$N_S + N_W = \delta w$$

wherein:

$N_S$ is the total membrane load (pounds per inch) configuration of the membrane configurations of each such given seam means and comprises at least substantially:

$$N_S = \frac{\sigma w(x)}{b(x + A_W E_W)}$$

wherein:

$\delta w$ is the total seam means load of such given seam means (pounds), $b$ is the total running width of the membrane configurations within such given seam means (inches), $A_W$ is the cross sectional area of the web means of such given seam means (square inches), $E_W$ is the modulus of elasticity of the web means of such given seam means (p.s.i.), and $$x = \frac{A_F{}^1E_F{}^1 + A_F{}^2E_F{}^2 + \ldots A_F{}^nE_F{}^n}{\Sigma m}$$

wherein:

$A_F{}^1, A_F{}^2 \ldots A_F{}^n$ is the cross sectional area of each respective membrane configuration of such given seam means (square inches), $E_F{}^1, E_F{}^2 \ldots E_F{}^n$ is the modulus of elasticity of each respective membrane configuration of such given seam means (p.s.i.), and $\epsilon$ m is the number of types of membrane configurations within such given seam means; wherein:

$N_W$ is the total seam web load (KIPS) configuration of each such given seam means and comprises at least substantially:

$$N_W = \frac{(\sigma w)\, A_W E_W}{A_W E_W + A_F E_F}$$

and wherein:

$A_F$ is the cross sectional area of the membrane configurations in such given seam means (square inches), $E_F$ is the modulus of elasticity of the membrane configurations of such given seam means; and within the design limits of:

$V \leqq 120$ MPH $H \leqq W/2$ $W \epsilon L$ and wherein:

V is the design wind velocity of the air supported structure (MPH),

H is the height of the air supported structure (feet), L is the length of the air supported structure (feet), and W is the width of the air supported structure (feet).

15. An air supported structure as specified in claim 14 wherein the stress configuration of each such membrane configuration ($N_\theta{}^1, N_\theta{}^2 \ldots N_\theta{}^n$) (pounds per inch) of such given seam means comprises at least substantially:

$$N_\Theta{}^1 = \frac{N_S(A_F{}^1E_F{}^1)}{b^1(A_F{}^1E_F{}^1 + A_F{}^2E_F{}^2 + \ldots A_F{}^nE_F{}^n)}$$

$$N_\Theta{}^2 = \frac{N_S(A_F{}^2E_F{}^2)}{b^1(A_F{}^1E_F{}^1 + A_F{}^2E_F{}^2 + \ldots A_F{}^nE_F{}^n)}$$

$$N_\Theta{}^n = \frac{N_S(A_F{}^nE_F{}^n)}{b^1(A_F{}^1E_F{}^1 + A_F{}^2E_F{}^2 + \ldots A_F{}^nE_F{}^n)}$$

wherein:

$b^1, b^2 \ldots b^n$ is the total running width of each such membrane configuration within such given seam means (inches).

16. An air supported structure as specified in claim 14 wherein the total fabric load configuration of each membrane configuration ($N_S{}^1, N_S{}^2 \ldots N_S{}^n$) (pounds) of such given seam means comprises at least substantially:

$$N_S{}^1 = \frac{N_S(A_F{}^1E_F{}^1)}{A_F{}^1E_F{}^1 + A_F{}^2E_F{}^2 + \ldots A_F{}^nE_F{}^n}$$

$$N_S{}^2 = \frac{N_S(A_F{}^2E_F{}^2)}{A_F{}^1E_F{}^1 + A_F{}^2E_F{}^2 + \ldots A_F{}^nE_F{}^n}$$

$$N_S{}^n = \frac{N_S(A_F{}^nE_F{}^n)}{A_F{}^1E_F{}^1 + A_F{}^2E_F{}^2 + \ldots A_F{}^nE_F{}^n}$$

17. An air supported structure as specified in claim 16 wherein the stress configuration of each such membrane configuration ($N_\theta{}^1, N_\theta{}^2 \ldots N_\theta{}^n$) (pounds per inch) of such given seam means comprises at least substantially:

$$N_\Theta{}^1 = \frac{N_S{}^1}{b^1}$$

$$N_\Theta{}^2 = \frac{N_S{}^2}{b^2}$$

$$N_\Theta{}^n = \frac{N_S{}^n}{b^n}$$

wherein:

$b^1, b^2 \ldots b^n$ is the total running width of each such membrane configuration within such given seam means (inches).

18. An air supported structure as specified in claim 1 wherein at least certain of said panel members comprise a plurality of membrane configurations and at least certain of such panel members are interconnected together by given seam means and the total membrane load ($N_S$) (pounds per inch) configuration of the membrane configurations of each such given seam means comprises at least substantially:

$$N_S = \frac{\sigma w(x)}{b(x + A_W E_W)}$$

wherein:

$\delta$ w is the total seam means load of such given seam means (pounds), $b$ is the total running width of the membrane configurations within such given seam means (inches), $A_W$ is the cross sectional area of the web means of such given seam means (square inches), $E_W$ is the modulus of elasticity of the web means of such given seam means (p.s.i.), and $$x = \frac{A_F{}^1E_F{}^1 + A_F{}^2E_F{}^2 + \ldots A_F{}^nE_F{}^n}{\Sigma m}$$

wherein:

$A_F{}^1, A_F{}^2 \ldots A_F{}^n$ is the cross sectional area of each respective membrane configuration of such given seam means (square inches), $E_F{}^1, E_F{}^2 \ldots E_F{}^n$ is the modulus of elasticity of each respective membrane configuration of each given seam means (p.s.i.), and $\epsilon$m is the number of types of membrane configurations within such given seam means; and within the design limits of:

$V \leqq 120$ MPH $H \leqq W/2$ $W \leqq L$ and wherein:

V is the design wind velocity of the air supported structure (MPH),

H is the height of the air supported structure (feet), L is the length of the air supported structure (feet), and W is the width of the air supported structure (feet).

19. An air supported structure as specified in claim 18 wherein the stress configuration of each such membrane configuration ($N_\theta^1$, $N_\theta^2$ . . . $N_\theta^n$) (pounds per inch) of such given seam means comprises at least substantially:

$$N_\Theta^1 = \frac{N_S(A_F^1E_F^1)}{b^1(A_F^1E_F^1 + A_F^2E_F^2 + \ldots A_F^nE_F^n)}$$

$$N_\Theta^2 = \frac{N_S(A_F^2E_F^2)}{b^2(A_F^1E_F^1 + A_F^2E_F^2 + \ldots A_F^nE_F^n)}$$

$$N_\Theta^n = \frac{N_S(A_F^nE_F^n)}{b^n(A_F^1E_F^1 + A_F^2E_F^2 + \ldots A_F^nE_F^n)}$$

wherein:

$b^1$, $b^2$ . . . $b^n$ is the total running width of each such membrane configuration within such given seam means (inches).

20. An air supported structure as specified in claim 18 wherein the total membrane load ($N_S^1$, $N_S^2$ . . . $N_S^n$) (pounds) configuration of each membrane configuration of such given seam means comprises at least substantially:

$$N_S^1 = \frac{N_S(A_F^1E_F^1)}{A_F^1E_F^1 + A_F^2E_F^2 + \ldots A_F^nE_F^n}$$

$$N_S^2 = \frac{N_S(A_F^2E_F^2)}{A_F^1E_F^1 + A_F^2E_F^2 + \ldots A_F^nE_F^n}$$

$$N_S^n = \frac{N_S(A_F^nE_F^n)}{A_F^1E_F^1 + A_F^2E_F^2 + \ldots A_F^nE_F^n}$$

21. An air supported structure as specified in claim 20 wherein the stress configuration of each such membrane configuration ($N_\theta^1$, $N_\theta^2$ . . . $N_\theta^n$) (pounds per inch) of such given seam means comprises at least substantially.

$$N_\Theta^1 = \frac{N_S^1}{b^1}$$

$$N_\Theta^2 = \frac{N_S^2}{b^2}$$

$$N_\Theta^n = \frac{N_S^n}{b^n}$$

wherein:

$b^1$, $b^2$ . . . $b^n$ is the total running width of each such membrane configuration within such given seam means (inches).

22. An air supported structure as specified in claim 1 wherein the crown harness load (N) (pounds) configuration of said crown harness means, the total seam means load ($\delta w$) (pounds) configuration of each said seam means of said central portion, and the total anchor load ($\epsilon a$) (pounds) configuration of said anchor means for each said web means of said central portion each comprises at least substantially:

$$N = \frac{(VH)^2 + 0.25(VW)^2}{7.33189H}$$

$$\sigma w = \frac{(VH)^2 + 0.25(VW)^2}{149.19H}$$

$$\sigma a = \frac{(VH)^2 + 0.25(VW)^2}{142.06H}$$

wherein:

V is the design wind velocity of the air supported structure (MPH),

H is the height of the air supported structure (feet), L is the length of the air supported structure (feet), and W is the width of the air supported structure (feet), and within the design limits of:

$V \leqq 120$ MPH $H \leqq W/2$ $W \leqq L$.

23. An air supported structure as specified in claim 22 wherein the total seam means load ($\delta w'$) (pounds) configuraion of each said seam means of each said end closure portion comprises at least substantially:

$$\delta w' = y(\delta w)$$

wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein:

$x$ is the percentage of half width of the structure (W/2) measured from the orthogonal corner in plan. $\delta$

24. An air supported structure as specified in claim 22 wherein the total seam means load ($\delta w'$) (pounds) configuration of each said seam means of each said end closure portion comprises at least substantially:

$$\sigma w' = \frac{\sigma w}{2}.$$

25. An air supported structure as specified in claim 22 wherein the total anchor load ($\delta a'$) (pounds) configuration of said anchor means for each said web means of each said end closure portion comprises at least substantially:

$$\delta a' = y\delta a)$$

wherein:

$y = 100.0$ within the limits $90.0 \leqq x \leqq 100.0$, $y = 100.0 \sin x$ within the limits $5.0 \leqq x \leqq 90.0$, and $y = 0.36x^2$ within the limits $0 \leqq x \leqq 5.0$;

and wherein:

$x$ is the percentage of half width of the structure (W/2) measured from the orthogonal corner in plan.

26. An air supported structure as specified in claim 22 wherein the total anchor load $\delta a'$) (pounds) configuration of said anchor means for each said web means of each said end closure portion comprises at least substantially:

$$\sigma a' = \frac{\sigma a}{2}.$$

* * * * *

UNITED STATES PATENT AND TRADEMARK OFFICE

Certificate

Patent No. 4,041,653 Patented August 16, 1977

Lloyd H. Rain

Application having been made by Lloyd H. Rain, the inventor named in the patent above identified, and Irvin Industries, Inc., Greenwich, Connecticut, a corporation of New York, the assignee, for the issuance of a certificate under the provisions of Title 35, Section 256, of the United States Code, adding the names of Terence W. McLorg and James J. Ford as joint inventors, and a showing and proof of facts satisfying the requirements of the said section having been submitted, it is this 10th day of October 1978, certified that the names of the said Terence W. McLorg and James J. Ford are hereby added to the said patent as a joint inventor with the said Lloyd H. Rain.

FRED W. SHERLING,
*Associate Solicitor.*